US008020327B2

(12) United States Patent
Schellingerhout et al.

(10) Patent No.: US 8,020,327 B2
(45) Date of Patent: Sep. 20, 2011

(54) DISPLAY OVER THE SLEEVE

(75) Inventors: Nicolaas Willem Schellingerhout, Eindhoven (NL); Kenny Darmadji, Delft (NL)

(73) Assignee: Creator Technology B.V., Breda (NL)

( * ) Notice: Subject to any disclaimer, the term of this patent is extended or adjusted under 35 U.S.C. 154(b) by 36 days.

(21) Appl. No.: 11/914,676

(22) PCT Filed: May 15, 2006

(86) PCT No.: PCT/IB2006/051520
§ 371 (c)(1),
(2), (4) Date: Feb. 25, 2008

(87) PCT Pub. No.: WO2006/123286
PCT Pub. Date: Nov. 23, 2006

(65) Prior Publication Data

US 2009/0126243 A1 May 21, 2009

Related U.S. Application Data

(60) Provisional application No. 60/681,836, filed on May 17, 2005.

(51) Int. Cl.
*G09F 21/02* (2006.01)

(52) U.S. Cl. ..... 40/586; 40/904

(58) Field of Classification Search ..... 40/586, 40/904
See application file for complete search history.

(56) References Cited

U.S. PATENT DOCUMENTS

| | | | | | |
|---|---|---|---|---|---|
| 1,670,176 | A * | 5/1928 | Woolery | 116/35 R |
| 3,763,646 | A * | 10/1973 | Jeanmonod | 368/277 |
| 3,968,643 | A * | 7/1976 | Curtil | 368/280 |
| 4,646,157 | A * | 2/1987 | Wakai et al. | 348/794 |
| 6,595,424 | B1 * | 7/2003 | Harrison | 235/472.02 |
| 6,696,986 | B1 * | 2/2004 | Harrison et al. | 341/22 |
| 7,120,936 | B2 * | 10/2006 | DeSantis | 2/123 |
| 7,470,244 | B2 * | 12/2008 | Harrison, Jr. | 602/21 |
| 2003/0050019 | A1 * | 3/2003 | Dowling et al. | 455/90 |

FOREIGN PATENT DOCUMENTS

| | | | |
|---|---|---|---|
| EP | 1 248 141 | A | 11/2002 |
| GB | 2 400 225 | A | 10/2004 |
| WO | WO 00/25193 | A | 5/2000 |
| WO | WO 2004/031927 | A2 | 4/2004 |

OTHER PUBLICATIONS

International Search Report for PCT/IB2006/051520 dated Jun. 9, 2006.

* cited by examiner

*Primary Examiner* — Casandra Davis

(57) ABSTRACT

A rollable display (101) is wearable on a sleeve (103). The display (101) is part of a wrist-based device with a "U" shape. A part of the device is on top of the sleeve (103). The display (101) can be rolled out for use as needed. The device itself may be flexible or bendable i.e. have a x-rigid, U-shape or may allow the "U" shape to be folded out, for example by a hinge or sequence of connected segments that can be rotated freely, but which keep their position after being moved. The display (101) may be rolled out from under the sleeve (103) and then over the sleeve (103) along a predefined curve by means of a guiding mechanism. The device is easy to use, allows the use of large displays that may always be visible and allows freedom in the display design with respect to the direction in which the flexible display (101) is rolled out.

5 Claims, 3 Drawing Sheets

DISPLAY OVER THE SLEEVE

FIELD OF THE INVENTION

The invention relates to an apparatus and method of wearable electronics, in particular to a convenient, easy to lay out and operate, wearable rollable or flexible display.

BACKGROUND

Electronic devices, such as computers, or personal data assistants (PDA's), often have a relatively thin display panel for viewing a visual display produced by the electronic device. In some of these electronic devices, the display panel is to some extent flexible, and can, for example, be spread or folded, e.g. over a surface that may be rigid, but may also be bendable, pliable or supple. The display panel may be rollable, in that in can be bent in successive layers around an axis and pulled out or unfurled for use, for example from a housing, in particular a tubular housing.

Electronic devices with displays may be wearable. A flexible image display apparatus may be attached to clothes, for example, as disclosed in patent publication no. US20020144442 A1, published Oct. 10, 2002, in patent publication no. US 20040187184 A1, published Sep. 30, 2004 and in patent publication no. US 20020019296 A1, published Feb. 14, 2002, which are incorporated herein by reference.

Flexible displays may be in a tablet-like form, including a central processing unit (CPU), drive circuitry for an active matrix of the display, memory storage unit and other components of the display. Tablet-like display panels sometimes include traditional control devices such as buttons, joysticks, thumbwheels, and touch pads, for controlling the image displayed on the display panel, inputting data, and moving cursors that are provided as part of the visual display. This approach is, for example, disclosed in United States Patent Application Publication US 2002/0070910 A1, to Fujieda, et al., PCT Publication WO/01/50232, to Zhang, et al, and PCT Publication WO 98/03962, of Johnson, et al., which are incorporated herein by reference.

Rollable as well as flexible displays are becoming commercially available. Very thin (e.g. 0.1 mm) flexible displays have been developed that can be rolled up to a radius of 1 cm. Rollable or flexible displays may have electrophoretic frontplanes of polymer material, joined to an active matrix backplane of material which is also flexible or rollable. The term "bendable" is used herein to mean a display or screen, connector or other display component that is flexible in any direction, including a direction of rotation, e.g. a display screen or ribbon cable or other connector that can be folded back on itself.

The display device may, however, also advantageously be a liquid crystal display device, electrochromic display device, reflective display device including, for example, an interferometric modulator and luminescent display device, rather than an electrophoretic display. The display devices may be passive or be an active matrix display. Examples of such active matrix display devices are TFT-LCDs or AM-LCDs, (O) LED devices, which are used in laptop computers and in organizers, and are also finding increasingly wider application in GSM telephones.

Prior, copending application 60/636,022 filed Dec. 14, 2004, which is incorporated by reference herein, discloses a "modular display super stick". A housing includes a rollable display panel which provides a large display in the unrolled position, and can be rolled in the housing when not use, thus providing a small form factor. The housing may also have drive electronics for the display, including, for example, a controller or processor and power source such as batteries.

SUMMARY OF THE INVENTION

In wearable electronics, effectively locating and using displays is a significant problem. Most wearables have a small rigid LCD displays for this reason. Flexible, and even rollable displays are an improvement: when rolled up, the display is well protected and occupies very little space, whereas when the display is rolled out, it is large and flexible, offering a high-resolution display area for all kinds of applications (such as travel guidance, in the form of GPS information, maps and travel guides, performance information while the user of the display is jogging, etc.).

The wrist, in particular, is a convenient place for wearable devices, for example, watches and even GPS devices, to be worn. A device worn on the wrist can, however, become difficult to operate in some circumstances, e.g. when the user is wearing long-sleeved clothes the sleeve may cover the device. This is especially true for rollable devices, where the space for rolling in and out of the display panel is an important action that must be accommodated in design and use of the display.

In the present invention, these and other problems are lessened or solved. A display device is provided which can be oriented to be worn over a sleeve or other part of the user's clothing. The device may, for example, be shaped to fold over or be capable of bending over the sleeve to be conveniently and easily operated.

A device according to one aspect the invention may have a "U"-shape, so that part of the device is on top of the sleeve. In this way, the device is visible, accessible and operable, without the user having to pull or roll up his or her sleeve.

In another aspect, the display panel of the device may be flexible or bendable, so that, for example, it can move with the surface of a jacket or shirt and be moved out of the way to remove the jacket or shirt.

In another aspect, a portion of the display device may be bendable to allow a flexible or rollable display panel of the device to be laid out over a sleeve or other area of clothing.

The wearable display may also be "wrapped" in that the surface opposite the display surface of a flexible display panel may have a display cover laminated to it or otherwise integrated with it and be capable of being folded out from an insert fixed, for example, as a removable part of a liner, attached under a sleeve or from behind a fold of fabric. The display panel is then set out and visible on the exterior of the user's clothing when in use and, when not in use, is folded back against the inside of the user's sleeve or other clothing and protected by the display cover.

In another aspect, a portion of the display device may be bendable to allow a display panel housing to be disposed over a sleeve or other area of clothing.

The display panel of the device may be detachable from the housing. The housing may include in addition to a display panel, other components of the display device, such as electronic apparatus to provide display parameters (such as driving signals, interface signals including a vertical synchronization pulse and clock signals), a battery, ac/dc converter or other power source, driving electronics and buttons or other control features. Components of the display such as an image display controller and telecommunications hardware and software may also be in the housing.

The display panel itself may be foldable, e.g. capable of being unrolled or otherwise set out in a folded position, after which it is unfolded.

The display panel may be given an interesting or even striking appearance, making the panel noticeable and even fashionable, for example as a cuff or trim. The display panel may show dynamic images or complement or enhance the textile or surface design of the user's clothing.

The display panel of the present invention offers an advantage in that space is available to prominently feature the branding for the display or other device in which it is incorporated. The visibility of the product allows the product to advertise itself.

The display panel may be a lighting device or have a lighting device, such as a semiconductor lighting device integrated into it.

The display device may serve as a monitor in a complex computer or other instrumentation system. For example, the rollable or flexible display panel may display data from a sensor or other components collecting and processing medical data from the surface of the skin or from a sensor extending beneath the skin. The display panel may show the user, for example, a graph of temperature or another biophysical or biochemical property, such as blood sugar, measured, invasively or non-invasively, over time or a comparison of two or more such properties.

In one embodiment the display may be a U-shaped device that is visible. The advantages of such a device include its ease of use, its allowing readily visible, large displays and, alternatively, its allowing more design freedom with respect to roll out directions for flexible displays, visibility in that a wrist-based device in a "U" allows the display to be seen on top of the sleeve, either rolled up or extended, at all times.

Another feature is that the device can be made flexible or bendable into a different shape, to enable a user to easily take off or put on clothing, for example, a jacket.

These and other aspects of the invention will be apparent from and elucidated with reference to the embodiment(s) described hereinafter. The detailed description and drawings are merely illustrative of the present invention, rather than limiting the scope of the present invention, the present invention being defined by the appended claims and equivalents thereof.

DETAILED DESCRIPTION OF THE DRAWINGS

Figure 1:
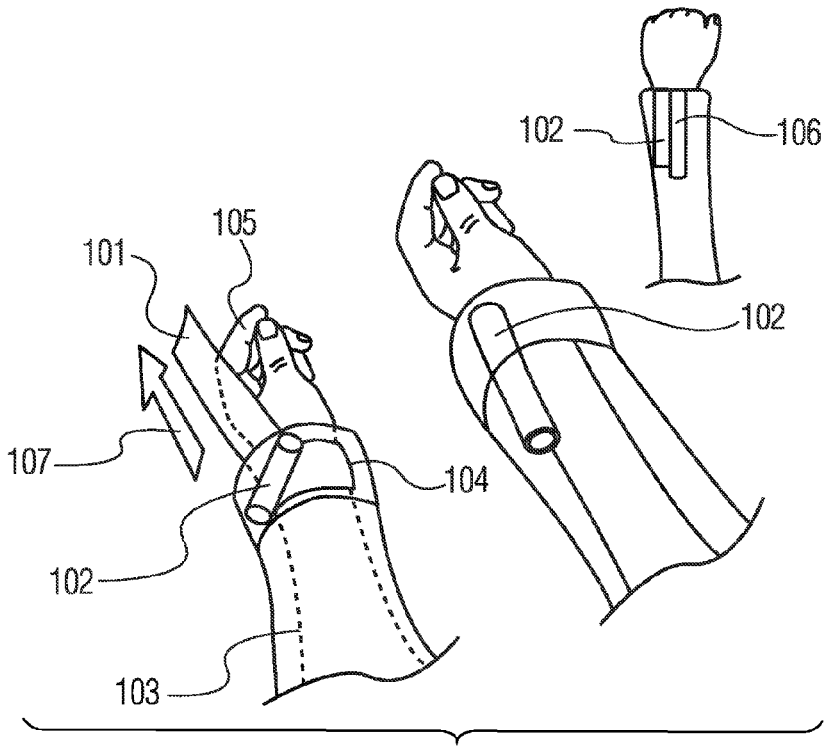
FIG. 1 shows a wearable display with a single roll-out direction.

FIG. 1 illustrates a wearable display with single roll out direction 107. A display panel 101 provided with driving electronics can be unrolled (e.g. substantially parallel to the arm) from a housing 102 which may, for example, be covered by a sleeve 103 of the user's clothing and held in place by a wrist strap 104. Alternatively, the housing 102 may be held on the wrist strap 104 by a clip 106 that allows the display panel 101 to be unrolled in a direction substantially perpendicular to the arm when the sleeve 103 is pulled back. With this design, when the user is wearing sleeves only one rollout direction that does not require the sleeve to be pulled back or the clothing to be removed is possible.

Figure 2A:
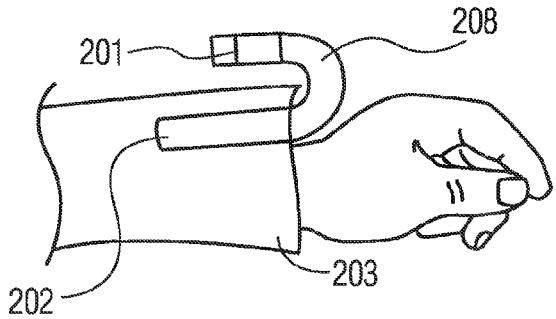
FIG. 2*a* shows a U-shaped wearable display.

A basic embodiment includes a rigid, U-shaped device. FIG. 2*a* shows a wearable display in the form of a "U" having a housing 202, bend 208 and wrappable, flexible or rollable display panel 201 kept on the wrist, but on top of the sleeve 203 at all times. Between the bend 208 and display panel 201 there may be a connection point, line or surface with a fitting or fittings for a quick connection and disconnection of the display panel, so that the display panel can be easily removed, for example when the user is passing through rough terrain where the display may be scratched or damage or when for any reason the user does not want the display to be visible. The display can be reattached when desired. The device is rigid only then in that the line, point or surface in which the connection is made is fixed with reference to some point outside the sleeve or other, outer garment surface on which the display panel 201 is arrayed.

Figure 2B:
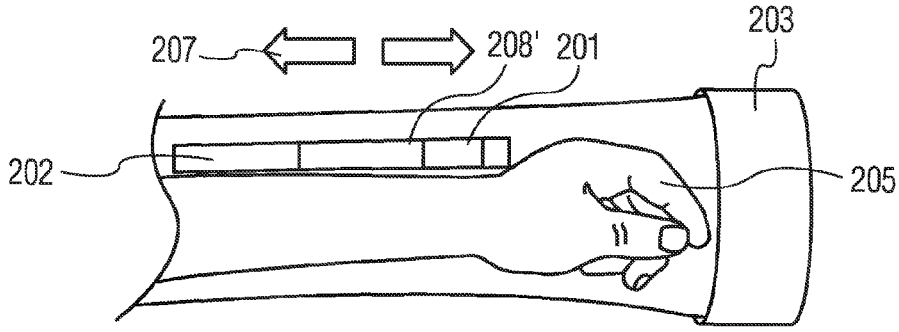
FIG. 2*b* shows a wearable display with a bendable portion.
Figure 3A:
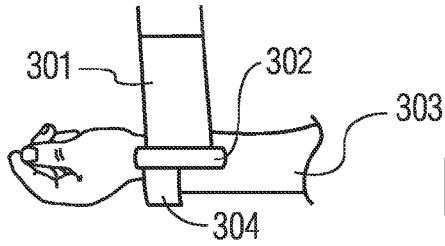
FIG. 3*a-e* shows wearable displays with various roll-out directions.
Figure 3B:
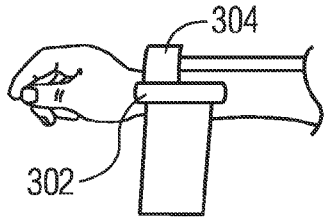
Figure 3C:
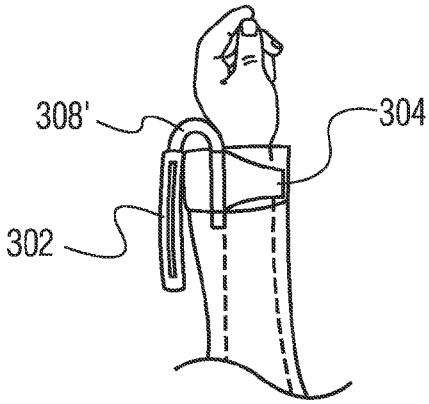
Figure 3D:
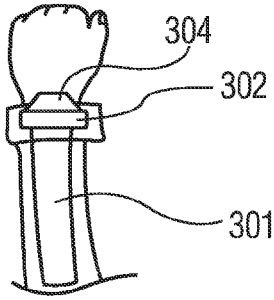
Figure 3E:
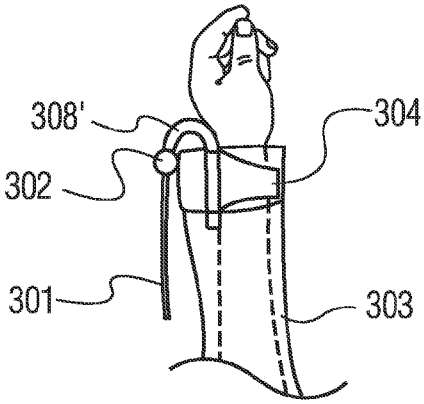

In another embodiment, shown in FIG. 2*b*, the device may have a bendable portion 208' which allows the display device to be kept flat against, for example, the user's arm or wrist. The bendable portion 208' of the display device connects the housing 202 and display panel 201. The user's sleeve 203 may be pulled back in a direction of movement 207 along the arm and/or the wearable display may be moved forward in the opposite direction to allow the bendable portion 208' to be moved to orient the display panel 201 on the exterior of the user's clothing.

Figure 4:
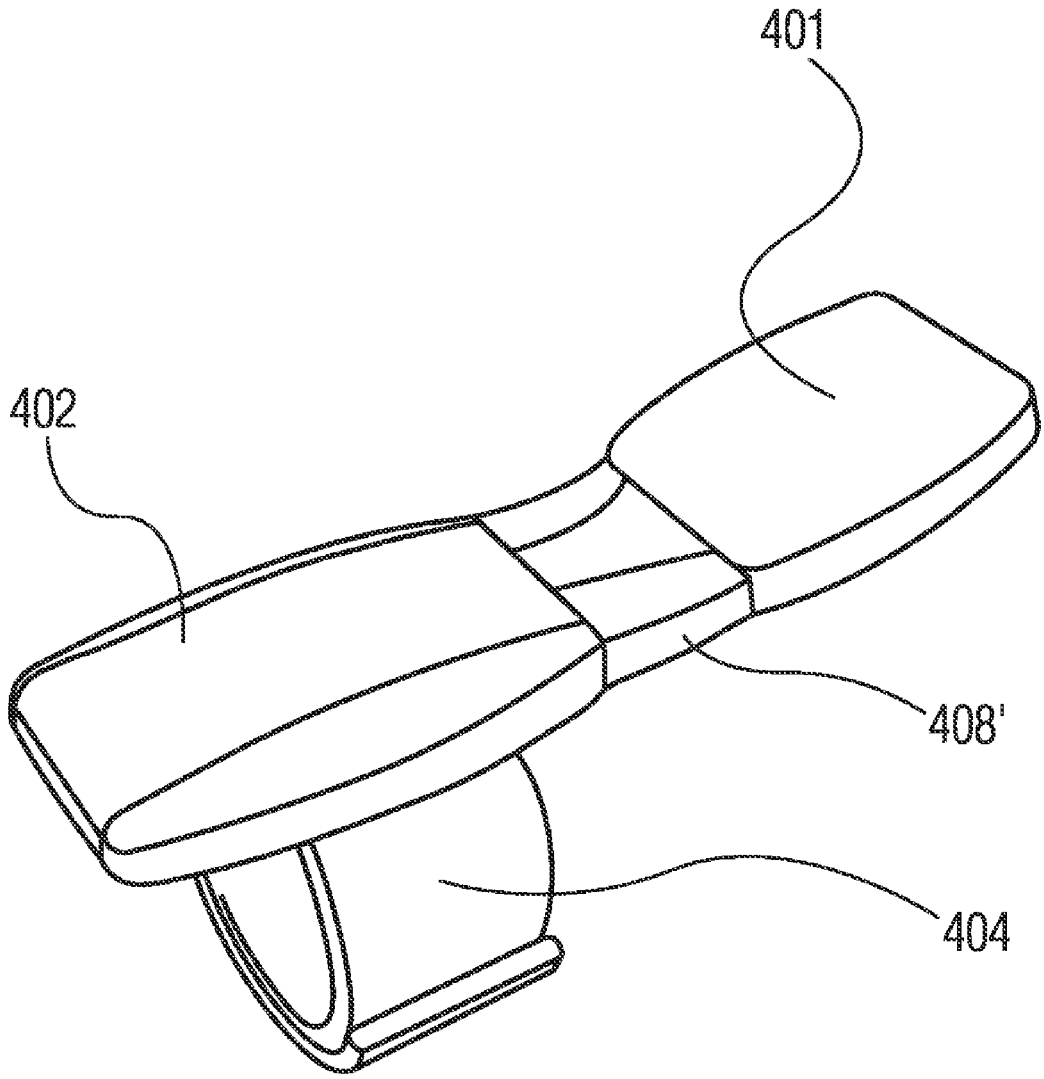
FIG. 4 shows a second wearable display with a bendable portion.

Some further embodiments of the invention are depicted in FIG. 3 and in FIG. 4. These embodiments, like the one in FIG. 2*b*, allow the device to assume a "U" shape to be folded out. The bendable portion 308' may be made bendable by means of, for example, a hinge or a flexible curve or neck made from a sequence of connected segments that can be rotated freely but keep their position due to friction (as is common in reading lamps), or a ribbon cable or by flexible wire connectors or other conductors embedded in or woven into a cloth or by any other structure or method which flexibly connects components of the display behind the sleeve or other fabric with a display panel outside on the sleeve or other fabric.

Embodiments of the present invention in which a tubular housing is extended outside the sleeve are shown in FIG. 3(*a*)-(*d*). In FIG. 3(*a*)-(*b*) the tubular housing 302 is simply strapped to the arm or wrist outside the sleeve with a length extending along the arm from which the display panel 301 is unrolled in a direction at a substantially right angle to the arm.

FIG. 3(*c*) illustrates a display device in which a bendable portion 308' in the form of a flexible curve or neck is held to the wrist by a wrist strap 304 and connected to the housing 302. The sleeve 303 can be pulled back allowing the housing 302, which had been kept behind or covered by the sleeve 303, to be pulled forward toward the hand. When the sleeve 303 is pulled forward, the housing 302 can be bent back so that is it positioned over the sleeve 303. The display can then be rolled out in a direction substantially perpendicular to the arm or any other direction desired.

As shown in FIGS. 3(*d*) and 3(*e*), a bendable portion 308' may also be used to position the housing 302 along the wrist more or less transverse to the length of a user's arm, allowing the display panel 301 to be extended substantially along or parallel to the arm.

The device does not preclude the display panel 301 or other components' being removable to further improve operability of the display. In FIGS. 3(*c*) and 3(*e*), for example, there may also be a quick connect or quick disconnect fitting between the bendable portion 308' and the housing 302, so that the user may easily remove the display panel and housing 302, if desired.

In another embodiment shown in FIG. 4 a bendable portion 408' may be between a housing 402 and a display panel 401. In FIG. 4 the housing 402 has a flat shape and is held to the wrist by a wrist strap 404. The display panel 401 in this embodiment may be flexible, but need not be rollable. The bendable portion 408' allows the display panel 401 to be folded outward toward the hand to be visible outside the sleeve. Alternatively, the display area of the display panel 401 may be located on a surface which faces away from the housing 402 when the bendable portion 408' is folded over the housing 402. The bendable portion 408' and the display panel 401 can then be folded over the sleeve, so that the display is visible over the sleeve.

A housing for the display, for example, the housing 302 in FIG. 3 may have two different parts. Such a housing is described in prior, copending application no. PCT/IB2003/004055, filed Oct. 4, 2003 which is incorporated by reference herein and made a part of this application. In PCT/IB2003/004055 a rollable display panel is provided inside a housing which has two parts, the display panel being situated in this example in one part in its rolled form, while the second part comprises further driving electronics and components, e.g., batteries, input devices (such as buttons), RF antenna, chips, memory, processors.

Another embodiment is a device where a flexible or rollable display as well as the other components of the display are both located under the sleeve. When the display is set out, it is applied over the sleeve along a predefined curve, for example, by means of a guiding mechanism.

Especially when used with rollable displays, the present invention makes available a wide range of roll out options for a display.

Although this invention has been described with reference to particular embodiments, it will be appreciated that many variations will be resorted to without departing from the spirit and scope of this invention as set forth in the appended claims. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts is intended to be required unless specifically indicated.

The invention claimed is:

1. An electronic device comprising:

a strap to attach to a user's arm;

a connecting assembly, including a bendable portion, connecting to the strap;

a housing connected between a point of attachment and the connecting assembly; and a foldable or rollable display panel, being concealable within the housing by folding or rolling when not in use, wherein the bendable portion is disposed between the strap and the display panel and the bendable portion is able to position the display panel with respect to the point of attachment, such that the bendable portion facilitates positioning the display panel in relation to a user's clothing.

2. The electronic device of claim 1, further comprising a quick connect fitting between the housing and the connecting assembly.

3. The electronic device of claim 1, wherein the bendable portion is selected from the group consisting of a hinge, a flexible neck, a ribbon cable, and a flap.

4. The electronic device of claim 1, wherein the bendable portion is bendable into a U-shape.

5. The electronic device of claim 1, wherein the strap is a wrist strap extending perpendicular to a longitudinal direction of the connecting assembly.

* * * * *